US011779805B2

(12) United States Patent
Kramer

(10) Patent No.: US 11,779,805 B2
(45) Date of Patent: Oct. 10, 2023

(54) EXERCISE APPARATUS FOR EXERCISING THE NECK MUSCLES

(71) Applicant: SENSOSPINE GmbH, Ehingen /Donau (DE)

(72) Inventor: Michael Kramer, Ehingen /Donau (DE)

(73) Assignee: Sensospine GmbH, Ehingen/Donau (DE)

( * ) Notice: Subject to any disclaimer, the term of this patent is extended or adjusted under 35 U.S.C. 154(b) by 17 days.

(21) Appl. No.: 17/568,260

(22) Filed: Jan. 4, 2022

(65) Prior Publication Data

US 2022/0126167 A1 Apr. 28, 2022

Related U.S. Application Data

(63) Continuation of application No. PCT/EP2020/068914, filed on Jul. 3, 2020.

(30) Foreign Application Priority Data

Jul. 4, 2019 (DE) ..... 10 2019 118 073.2

(51) Int. Cl.
*A63B 23/025* (2006.01)
*A63B 21/00* (2006.01)
*A63B 21/02* (2006.01)

(52) U.S. Cl.
CPC ..... *A63B 23/025* (2013.01); *A63B 21/023* (2013.01); *A63B 21/4003* (2015.10); *A63B 2225/09* (2013.01)

(58) Field of Classification Search
CPC . A63B 23/025; A63B 21/023; A63B 21/4003; A63B 2225/09; A63B 21/008; A63B 21/062; A63B 71/0054; A63B 2208/0233; A63B 2225/093; A63B 21/152; A63B 21/155; A63B 21/156; A63B 21/4039; A63B 21/4045; A63B 21/4049
See application file for complete search history.

(56) References Cited

U.S. PATENT DOCUMENTS 3,290,985 A * 12/1966 Bains ..... A61B 5/1114 359/896
4,278,249 A * 7/1981 Forrest ..... A63B 23/025 482/10
4,458,689 A * 7/1984 Sorenson ..... A61B 8/4209 600/447
4,706,955 A * 11/1987 Ngadi ..... A63B 51/16 269/238
4,846,474 A * 7/1989 Chiang ..... A63B 51/14 473/555

(Continued)

*Primary Examiner* — Garrett K Atkinson
(74) *Attorney, Agent, or Firm* — Muncy, Geissler, Olds & Lowe , P.C.

(57) ABSTRACT

An exercise apparatus for exercising the neck muscles with a frame and an exercise mechanism which is mounted on the frame, which can be coupled to a coupling member that can be worn on or around the head of a person who is exercising, wherein the exercise mechanism comprises a cross slide which makes available two translation axes on which a rail is mounted so as to be adjustable in height and rotatable, in such a way that, by means of the exercise mechanism, the coupling member is rotatable about three rotation axes and is movable in translation along three translation axes.

17 Claims, 6 Drawing Sheets

(56) References Cited

U.S. PATENT DOCUMENTS 4,893,808 A * 1/1990 McIntyre ..... A63B 23/025 482/901
4,954,815 A * 9/1990 Delmonte ..... A63B 23/025 600/595
5,116,359 A * 5/1992 Moore ..... A61H 1/008 601/25
5,252,070 A * 10/1993 Jarrett ..... G09B 9/10 434/30
5,345,087 A * 9/1994 Luber ..... A61B 34/74 250/203.2
5,928,117 A * 7/1999 Vittone ..... A63B 23/12 482/99
5,984,836 A * 11/1999 Casali ..... A63B 21/4003 602/17
5,997,440 A * 12/1999 Hanoun ..... A61B 5/1121 600/595
6,019,705 A * 2/2000 Thom ..... A47D 13/04 482/52
6,143,003 A * 11/2000 Cosman ..... A61B 90/16 128/846
6,152,854 A * 11/2000 Carmein ..... A63G 31/16 198/779
6,331,152 B1 * 12/2001 Holle ..... A47C 3/02 472/27
6,551,214 B1 * 4/2003 Taimela ..... A61H 1/0296 601/39
7,104,926 B2 * 9/2006 Carlson ..... A63B 21/023 601/39
7,935,026 B2 * 5/2011 McSorley ..... A63B 23/16 482/44
8,636,631 B2 * 1/2014 Carlson ..... A63B 21/222 482/79
8,876,665 B1 * 11/2014 Isom ..... A63B 23/025 482/93
9,163,796 B2 * 10/2015 Moshtagh ..... F21V 29/75
9,427,372 B1 * 8/2016 Minassian ..... A61H 1/0281
9,873,015 B2 * 1/2018 Jolly ..... A63B 21/4003
10,143,883 B2 * 12/2018 Jolly ..... A63B 21/4043
11,020,631 B2 * 6/2021 Walker ..... A63B 24/0087
2002/0016561 A1 * 2/2002 Prinsloo ..... A61F 5/3792 602/17
2003/0134721 A1 * 7/2003 Greenland ..... A63B 21/078 482/93
2004/0033863 A1 * 2/2004 Carlson ..... A63B 21/023 482/121
2004/0220500 A1 * 11/2004 Dahl ..... A61H 1/0218 601/25
2009/0192026 A1 * 7/2009 Mason ..... A63B 21/4035 482/97
2012/0220428 A1 * 8/2012 Carlson ..... A63B 21/222 482/8
2016/0157543 A1 * 6/2016 Huang ..... A63B 71/10 2/411
2017/0127747 A1 * 5/2017 Thalken ..... A42B 3/046
2020/0069998 A1 * 3/2020 Smith ..... A63B 23/025
2020/0222754 A1 * 7/2020 Walker ..... A63B 23/025
2021/0268332 A1 * 9/2021 Smith ..... A61B 5/22

* cited by examiner

EXERCISE APPARATUS FOR EXERCISING THE NECK MUSCLES

This nonprovisional application is a continuation of International Application No. PCT/EP2020/068914, which was filed on Jul. 3, 2020, and which claims priority to German Patent Application No. 10 2019 118 073.2, which was filed in Germany on Jul. 4, 2019, and which are both herein incorporated by reference.

BACKGROUND OF THE INVENTION

Field of the Invention

The present invention relates to an exercise apparatus for exercising the neck muscles.

Description of the Background Art

In order to prevent neck pain, degenerative changes in the cervical spine or work-related neck pain (for example, in jet pilots, helicopter pilots or athletes), as well as for the treatment of balance disorders, degenerative and traumatic neck pain, it is necessary to exercise the neck muscles. The movement of the cervical spine is extremely complex. The movement does not take place via an isolated axis, but in several planes with several degrees of freedom, which also change their position to each other during a movement of the head. The physiological head rotation is thus composed of the sum of a combination of a rotational, lateral flexion and flexion/extension component of each individual vertebral body of the cervical spine changing during movement.

Known exercise apparatuses for reproducing the natural movement of the cervical spine are mechanically complex and large. They do not take into account the complex topology change of the individual vertebral bodies during the physiological head movement of the healthy person and the increased sensitivity or painfulness of the neck to activity-related movements in patients. Exercising with known purely mechanical designs also usually requires the acceleration of considerable masses. The associated inertia runs counter to physiological exercising and can be perceived as unpleasant and unnatural.

Known exercise apparatuses with electromagnetic force generation pose risks in the event that undesirable forces are exerted on the sensitive structures of the cervical spine of the person who is exercising in the case of malfunction. A design with purely mechanical (passive) force generation does not present risks in this form.

SUMMARY OF THE INVENTION

It is therefore an object of the present invention to provide an exercise apparatus which enables physiologically effective exercising of the neck muscles and reduces or eliminates the aforementioned disadvantages.

In an exemplary embodiment, the exercise apparatus for exercising the neck muscles has a frame and an exercise mechanism which is mounted on the frame, and which can be coupled to a coupling member that can be worn on or around the head of a person who is exercising. The exercise mechanism comprises a cross slide which makes available two translation axes, wherein a rail is mounted on the cross slide so as to be adjustable in height and rotatable, in such a way that, by means of the exercise mechanism, the coupling member is rotatable about three rotation axes and is movable in translation along three translation axes.

This enables a coupled movement of the neck muscles or the cervical spine and thus physiological exercising of the neck muscles, in which in each case flexion/extension, lateral flexion and rotational movement can be exercised with only one apparatus. Therefore, free mobility of the cervical spine in all degrees of freedom is made possible for physiologically desirable mobility.

The cross slide can comprise a first slide and a second slide which is arranged orthogonally to the first slide and movable on the first slide. In addition, it is preferred if a translator is present, which is mounted so as to be movable on the first slide. This enables a translational movement of the coupling member along a first translation axis and a second translation axis orthogonally arranged to the first translation axis and thus an exercising of the neck muscles and/or the cervical spine along the first translation axis and the second translation axis. The translator is preferably indirectly coupled to the coupling member. In one embodiment, the two slides may be arranged in the same plane, while in a second embodiment they may be arranged in two different planes. Furthermore, it is also possible in an alternative embodiment that the two slides are not orthogonally on top of each other, but at an angle to each other.

The height-adjustable rail can be guided in a guide. Furthermore, the rail and the guide are arranged at an angle, preferably orthogonally to the cross slide, i.e., the rail and the guide are arranged orthogonally to the first slide and orthogonally to the second slide. By means of the orthogonal arrangement of the rail and the guide to the cross slide, exercising of the neck muscles and/or the cervical spine about a third translation axis is made possible. The intersection of the three translation axes in this arrangement lies at a fastening point of the rail or the guide on the translator. The rail and/or the guide is preferably arranged in the middle or centrally on the translator. In a particularly preferred embodiment, the rail is mounted on the translator so as to rotate about one of the first of the rotation axes. This also allows for the rotation of the coupling member about the first axis of rotation, and thus the exercising of the neck muscles about the first axis of rotation, i.e., a lateral flexion movement.

In order to enable physiologically optimal exercising, the axes of rotation can have a common intersection in the area of the cervical spine of the person who is exercising. The positional relationships of the individual axes of rotation can dynamically follow the individual cervical spine mobility during the head movement of the person who is exercising, wherein the axes of rotation remain in a narrow area near the cervical spine during the movement to enable physiological exercising. This also prevents the coupling member from detaching from the person who is exercising during certain movements and/or prevents injury. In this context, it is provided in particular that the intersection of the axes of rotation is at the center, in particular near the center of the base of the dens axis (odontoid process of the 2nd cervical vertebra). It should be noted that the intersection is not to be understood as being rigidly point-like in the strict mathematical sense but can also be described as wandering in the skull in the space below the region of the stella turcica.

The rotatability of the coupling member about the three rotation axes can be achieved by a ball joint or by a gimbal. In order to make the exercising of the neck muscles even gentler, however, it is preferable if the rail carries a bracket, which make available a second of the rotation axes and a third of the rotation axes. The rail itself is thus mounted on the translator so as to rotate about a first of the rotation axes and is directly or indirectly connected to a bracket that allows for rotational movement of the coupling member about the second and the third axes of rotation.

The bracket can be formed as an arch running horizontally at the level of the cervical spine of the person who is exercising or as a U-piece, which is directly or indirectly connected to the rail by means of a rotary joint. The bracket, i.e., the arch or the U-piece is thus, at least partially, preferably guided horizontally at the level of the cervical spine around the coupling member and thus around the person who is exercising. This allows for the coupling member to rotate about the second axis of rotation. In order to allow for the coupling member to rotate about the third axis of rotation, it is preferred if at least one of the free ends of the arch or the U-piece can be coupled to the coupling member, preferably at the level of the ear canal of the person who is exercising. In particular, both free ends of the arch or the U-piece can be coupled to the coupling member at the level of one ear canal of the person who is exercising. This arrangement allows for the three axes of rotation to have a common intersection at the level of the cervical spine, thus reducing the risk of injury during exercise.

The connection between the arch or the U-piece and the rail can be made via an angled connecting piece, preferably angled by 90°.

Furthermore, at least one training resistance is present, the force of which transferred to the coupling member is adjustable as a function of the movement and/or the angular position of the coupling member. The at least one training resistance may preferably be designed as a spring or as a weight. Alternatively, the training resistance can be formed as a hydraulic link, as a linear motor, eddy current brake or another device generating mechanical resistance. In addition, it is preferred if the at least one training resistance is arranged outside the cross slide to keep the mass to be moved low, and thus to minimize the risk of injury.

The adaptability of the force acting on the coupling member can be made possible by the fact that the at least one training resistance transfers the force to the coupling member by means of a rope pull.

A length compensator can be provided, over which the rope pull is guided in such a way that the length of the rope pull and thus the force transferred by means of the at least one training resistance on the coupling member is adjusted as a function of the translational movement and/or the rotational movement.

The at least one length compensator may be formed as a plate, for example a trapezoidal plate, on which two rotatably mounted rope guides are arranged, which guide the rope pull and are pre-tensioned by means of a spring force. In each case, one end of the rope guides is preferably moveably guided in a receptacle, preferably in a slotted hole, wherein in the receptacle also a spring force is moveably guided. Preferably, in each case a rope guide is connected or connectable to one of the spring forces. The rope guide and/or the spring force are preferably also fixable within the receptacle.

Alternatively, or additionally, the length compensator may be formed as a disc, preferably as an elliptical disc, at which outer circumference a groove is formed in which the rope pull is guided. This makes possible a particularly easy-to-manufacture length compensator.

The at least one training resistance can be formed by a resistor which generates a resistance by a change in position of its at least one end against a force, wherein its other end is eccentrically attached to a disc. In other words, the force generating the training resistance is generated by at least one resistor, the other end of which can be attached in a hanging manner and eccentrically in such a way to a disc that a rotation of the disc produces an up and down movement of the resistor or at least one end of the resistor against gravity. This allows for physiological exercise with a particularly advantageous force curve. Around this disc, the rope pull is guided in such a way that a change in angle of the coupling member causes a rotation of the disc. Preferably, the diameter of the disc is chosen such that a fully executed exercise movement results in a rotation of the disc by less than 180 angular degrees.

Alternatively, it is provided that the at least one training resistance is formed by a resistor which generates a resistance by a change of position of its at least one end against a force, wherein its other end is attached via an additional rope pull to a non-circular disc force-locked with a disc. The non-circular disc can be formed as an elliptical disc or as an angular disc. This allows for a different force-angle curve to be generated depending on the shape of the non-circular disc.

The resistor can be a weight or a spring, as at least one hydraulic link, as at least one linear motor, as at least one eddy current brake or at least another known device to generate mechanical resistance.

In order for the rotational movements of the coupling member, but not the translational movements of the slides, to cause a movement and/or change in length of the rope pull, it is provided in particular that, at or on the frame, a bridge construction, which is articulately connected to the slide, also consists of articulated elements and has rope deflection rollers, is arranged for a length compensation of the rope pull for the rotational movements, which compensates for the changes in length of the rope pulls coming from the coupling member caused by simultaneous translational movements of the slide.

In order to improve and stabilize the transfer of force to the neck muscles, it is preferred if the coupling member is formed as a helmet. Alternatively, the coupling member may also be formed from at least two interconnected shells, which are preferably adjustable by means of a ring.

In order to expand the exercise options and also to train situations in which the head movement is triggered by a perception of the sensory organs, it is provided that an optical stimulus is available for the optical triggering of the head movement.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
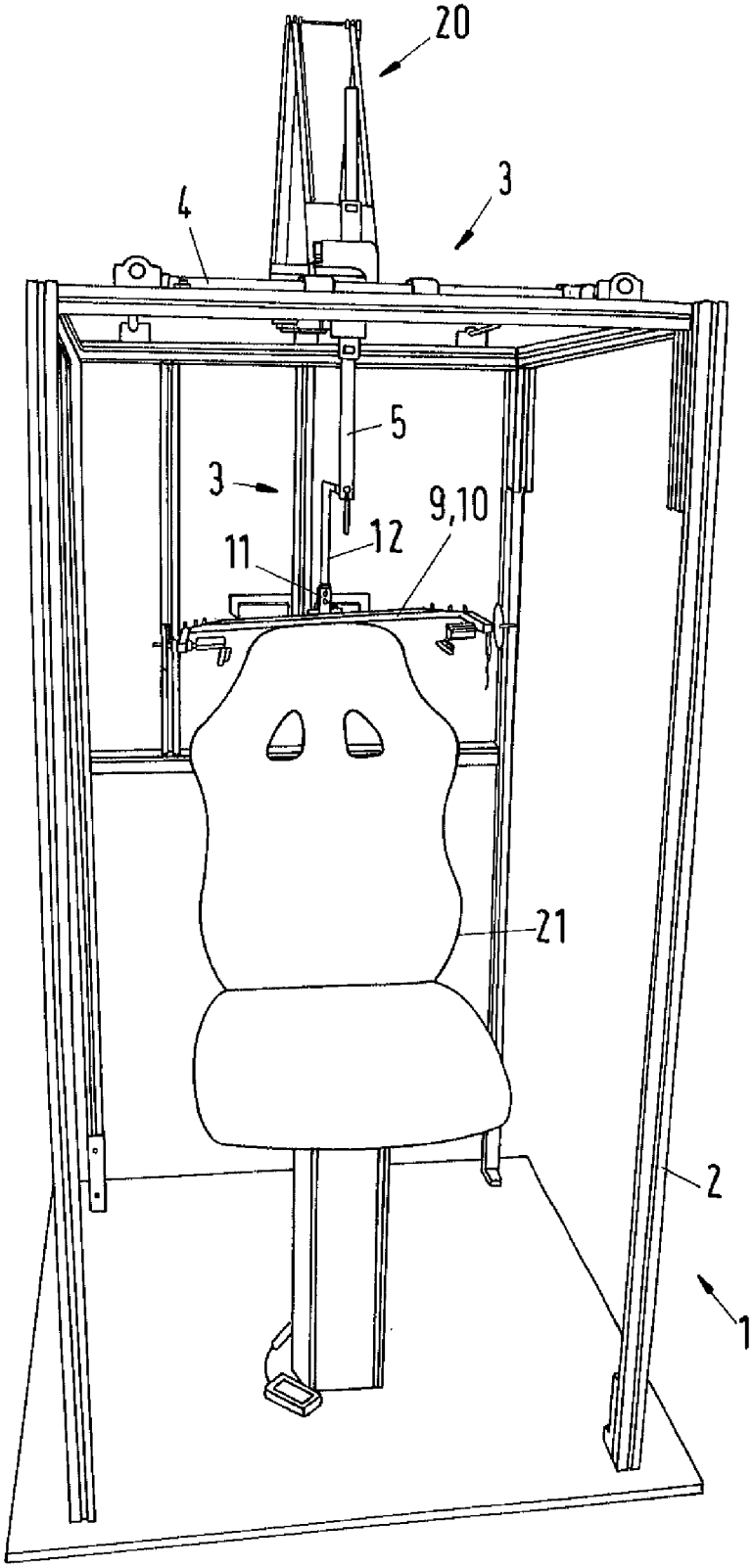
FIG. 1 is a front view of the exercise apparatus.

FIG. 1 shows the exercise apparatus 1 for exercising the neck muscles, which has a frame 2 and an exercise mechanism 3 attached to the frame 2. The coupling member, not further shown, which can be worn on or around a head of a person who is exercising, can be coupled to the exercise mechanism 3. The coupling member can be formed as a helmet or as at least two interconnected shells adjustable by means of a ring. In the present embodiment, the apparatus has a seat 21 or a chair, so that the person who is exercising exercises while sitting. In a particularly simple embodiment, only a seating surface or a stool may be provided. Furthermore, it is also possible that the person who is exercising exercises while standing or kneeling.

Figure 2:
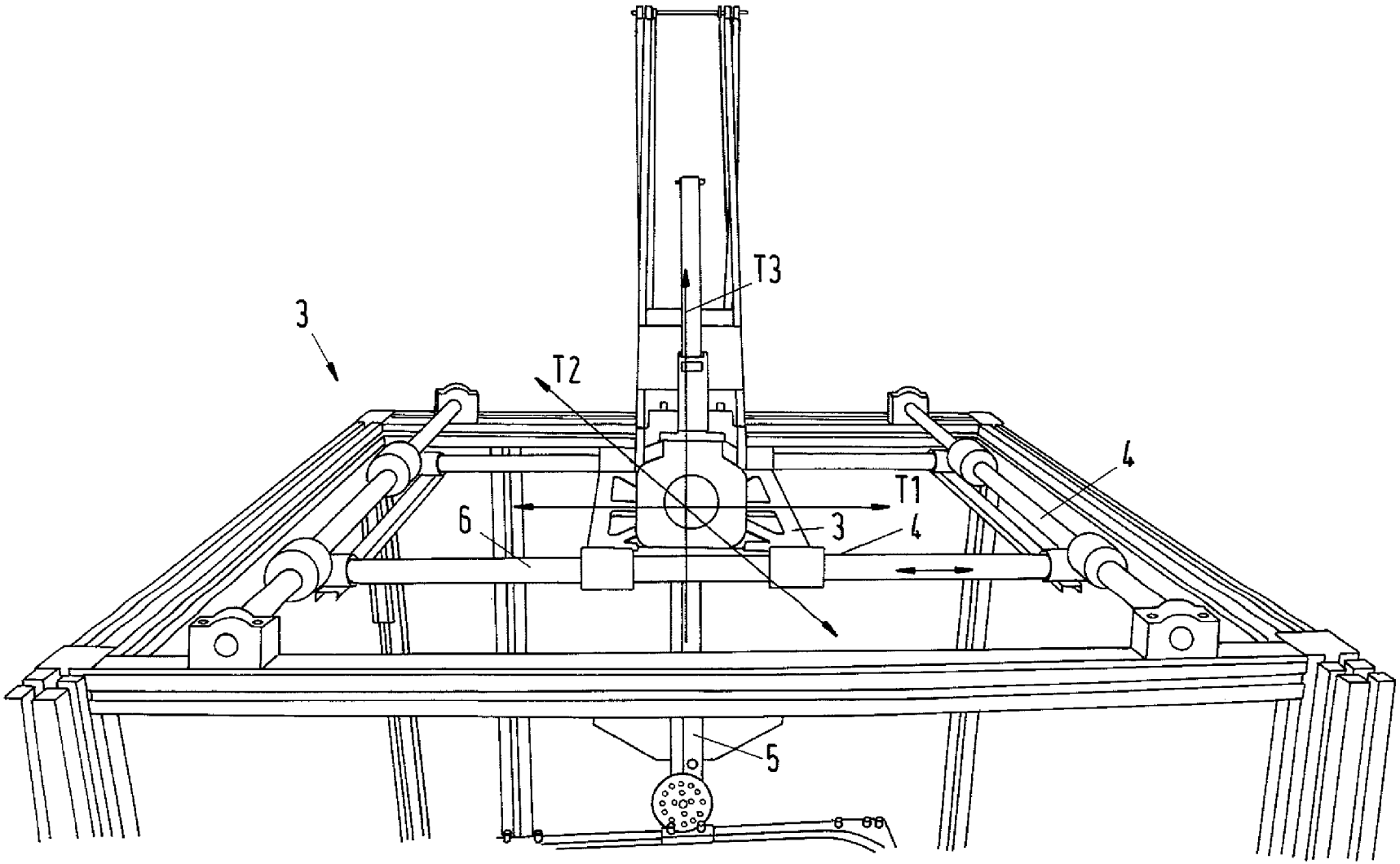
FIG. 2 is a detailed view of the cross slide.

The exercise mechanism 3 includes a cross slide 4, which is shown in more detail in FIG. 2. The cross slide 4 has a first slide 6 and a second slide 7 arranged orthogonally to the first slide 6 and movable on the first slide 6. On the first slide 6, a translator 8 is movably arranged, so that the translator 8 is movable along a first translation axis T1 on the first slide 6 and can also be moved on the second slide 7 along a second translation axis T2, which lies orthogonally on the first translation axis T1, via the movement of the first slide 6. In the present case, the two slides 6,7 and the translator 8 are arranged in one plane. However, it is also possible to arrange the slides 6,7 on top of each other or below each other. In the middle of the translator 8, a rail 5 guided in a guide can be rotated about a first of the axes of rotation. The rail 5 is also height-adjustable in the guide, which enables an up and down movement of the coupling member, i.e., a translational movement along a third translation axis T3. In the present case, the rail 5 is arranged in the middle with respect to the translator 8 and centrally with respect to the coupling member or the head of the person who is exercising. This allows for a movement of the head of the person who is exercising or of the coupling member to the right and to the left, so that the first axis of rotation R1 corresponds to the anatomical axis of rotation of the cervical spine.

The rail 5 and/or the guide further carry a bracket 9, which makes available a second rotation axis R2 and a third rotation axis R3. For this purpose, the free leg of the rail 5 is connected via a connecting piece 12 preferably angled at 90° with a U-piece 10 at least partially guided around the coupling member. The U-piece 10 runs horizontally at the level of the cervical spine of the person who is exercising. The free end of the connecting piece 12 is connected to the U-piece 10 by means of a rotary joint 11, so that a rotational movement about the second rotation axis R2, which lies orthogonally on the first rotation axis R1, is possible.

Figure 3:
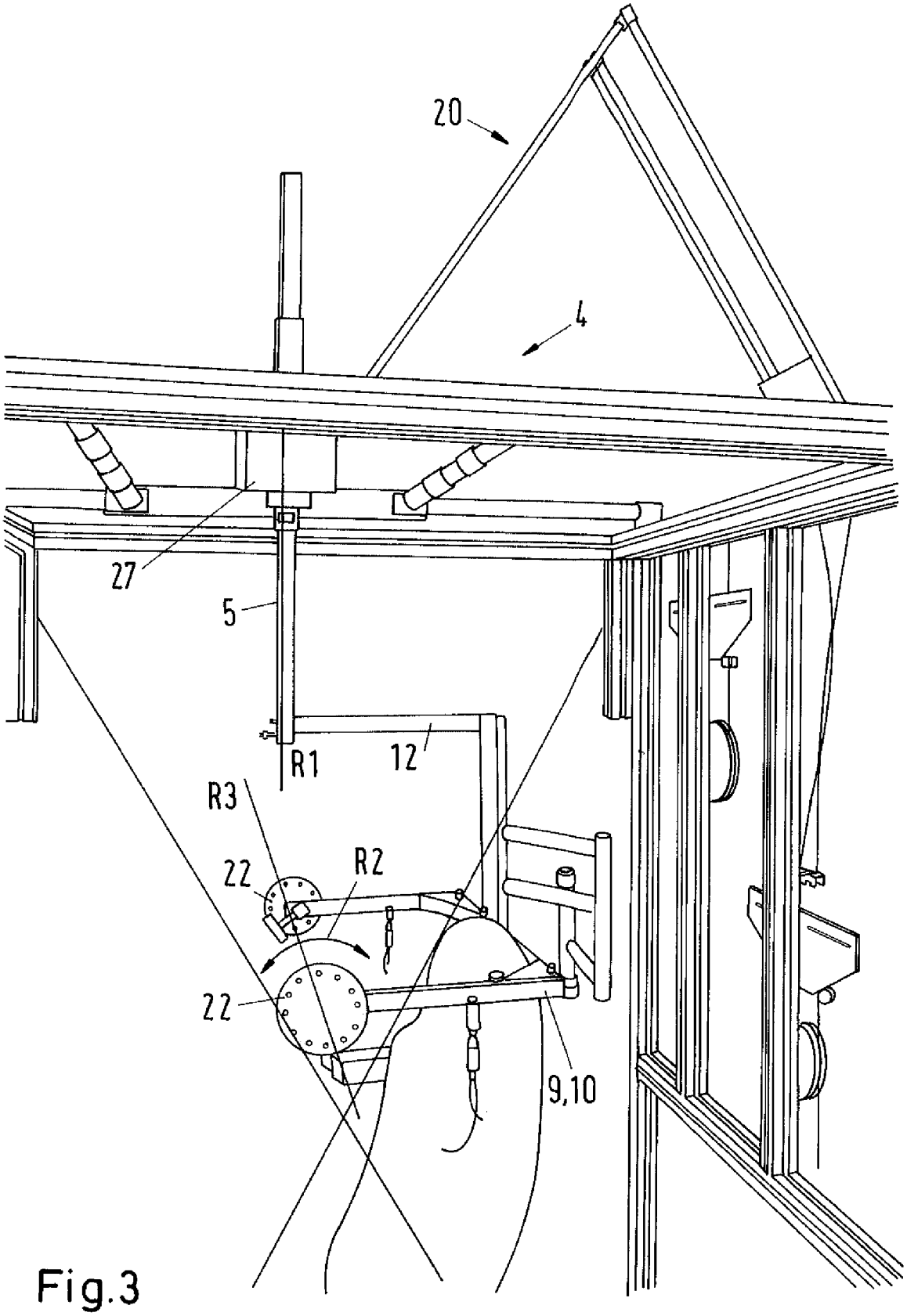
FIG. 3 is a detailed view of the exercise mechanics.

On the free legs of the U-piece 10, as can be seen from FIG. 3, a further rotary joint 22 or a rotary disc is arranged in each case, by means of which the U-piece 10 can preferably be coupled to the coupling member at the level of the ear canal of the person who is exercising. By means of this additional rotary joint 22, a rotation of the coupling member, i.e., of the head of the person who is exercising about the third axis of rotation R3, which in turn stands orthogonally on the other axes of rotation R1, R2, is made possible. Due to this arrangement, it is possible for the coupling member to be rotated about the three rotation axes R1, R2, R3 by means of the exercise mechanism 3 and to be translated along three translation axes T1, T2, T3. Furthermore, the rotation axes R1, R2, R3 thereby have a common intersection, which is in the area of the cervical spine of the person who is exercising, preferably at the center of the base of the dens axis of the person who is exercising. This prevents injuries or incorrect exercising and also simulates the natural movement of the head or neck muscles consisting of flexion/extension/rotation and lateral flexion movements.

Figure 4:
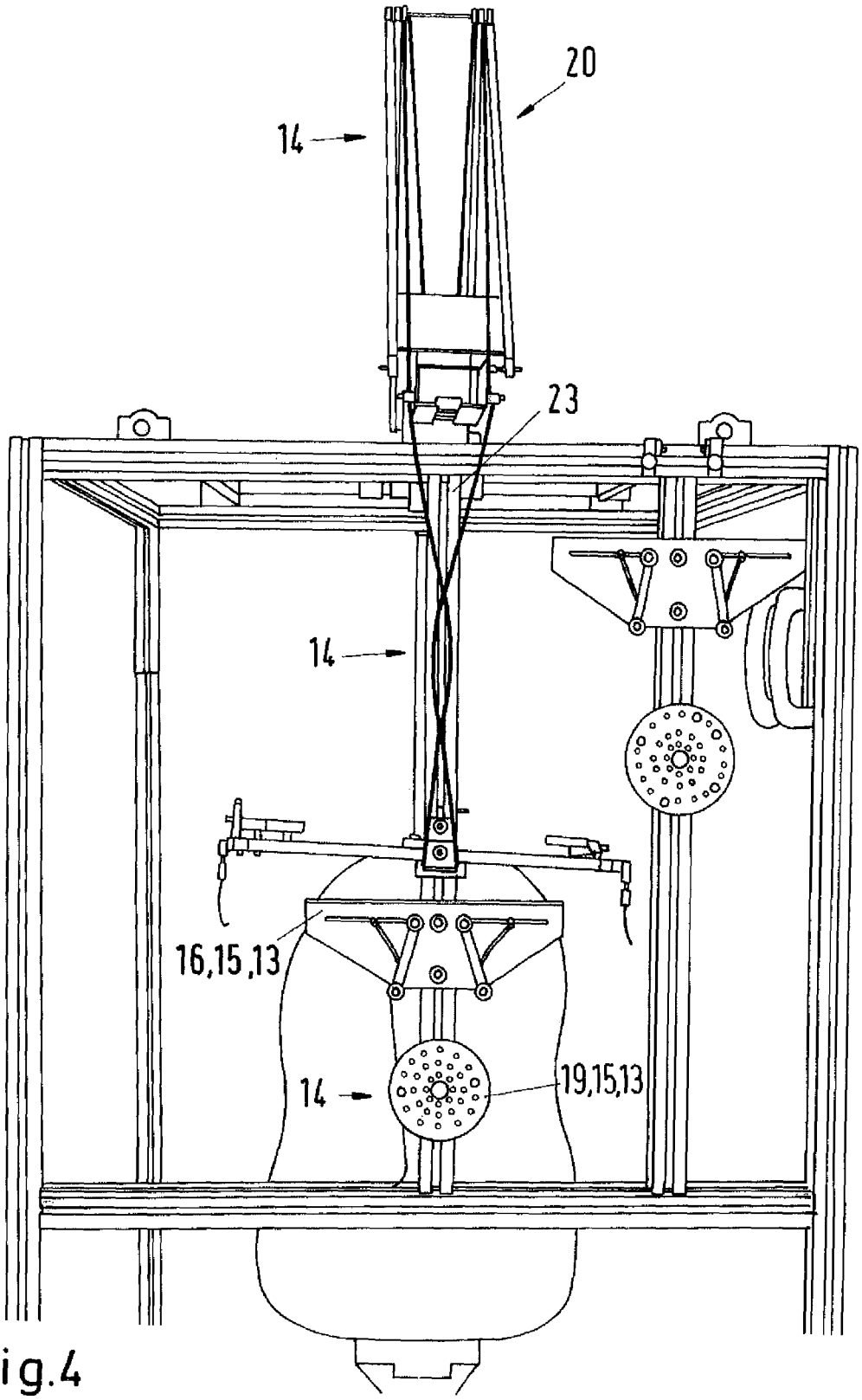
FIG. 4 is a rear view of a part of the frame and the exercise mechanism of the exercise apparatus.

The neck muscles can be exercised by means of a training resistance 13. For this purpose, the exercise apparatus 1 has at least one training resistance 13, which can be designed, for example, as a spring or as a weight. In the present case, the training resistance 13 is formed as a weight, namely as a disc 19 and as a plate 16, in this case as a trapezoidal plate, as shown in more detail in FIGS. 4 and 5. The plate 16 and the disc 19 are movably mounted outside the cross slide 4 on another rail 23. The further rail 23 is arranged on a rear wall of the frame, i.e., behind the coupling member or behind the person who is exercising. FIG. 4 also shows that the frame may have a second or several additional rails 23, on which another plate 16 and/or another disc 19 is movably mounted. This increases the number of training resistances 13.

In order to adjust the force transferred to the coupling member as a function of the angular position of the coupling member, the weight force of the training resistance 13 is transferred to the coupling member by means of a rope pull 14. In the present case, the training resistances 13 are also formed as length compensator 15, over which the rope pull 14 is guided such that the length of the rope pull 14 and thus the force transferred to the coupling member by means of the training resistances 13 is adjusted as a function of the translational movement and/or the rotational movement. A groove is formed on the outer circumference of the disc 19 around which the rope pull 14 is guided to the trapezoidal plate 16.

Figure 5:
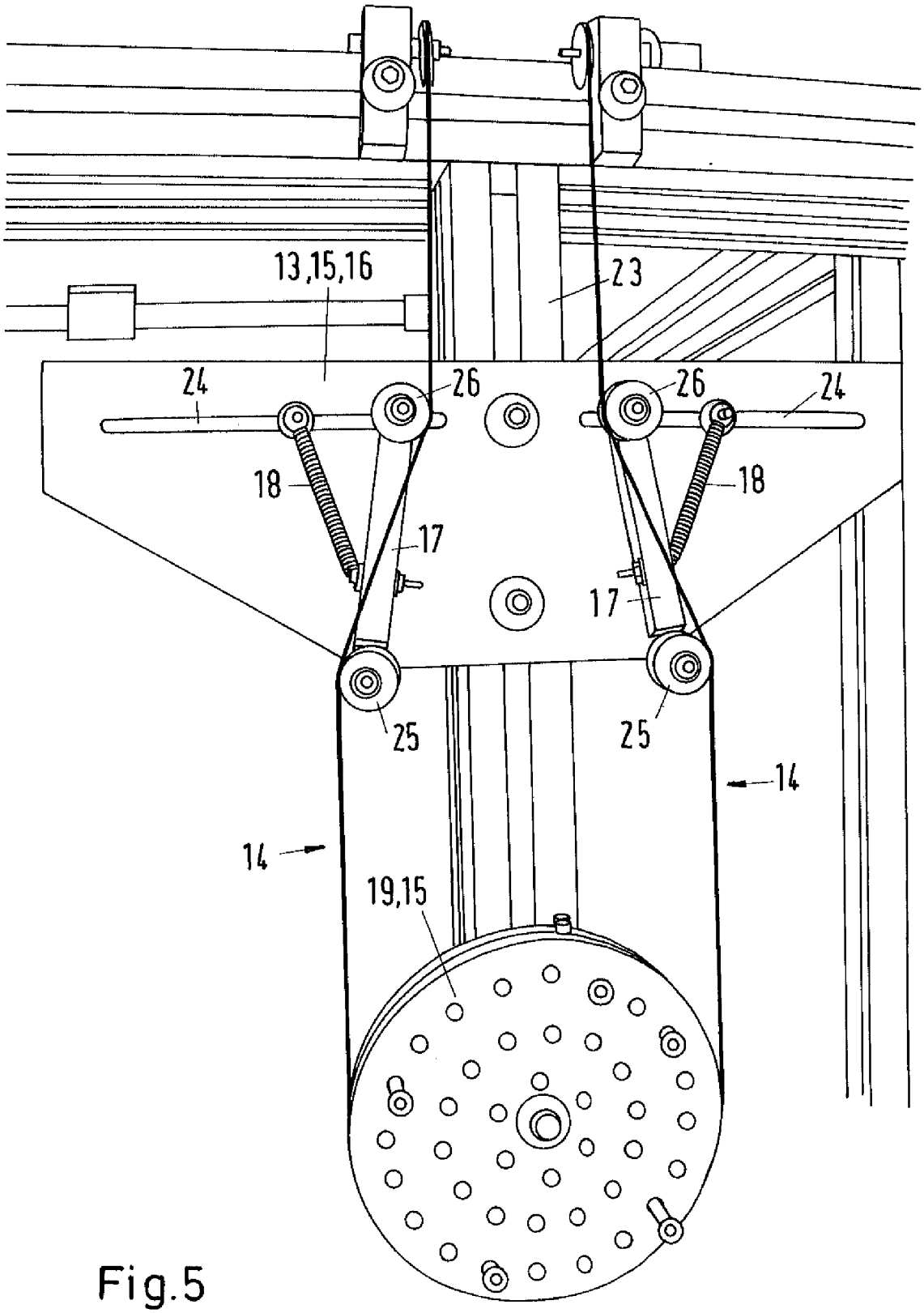
FIG. 5 is a detailed view of the rear view with the length compensator and the training resistances.

The trapezoidal plate 16 has, as can be seen in particular from FIG. 5 in detail, two rope guides 17, each of which is movably guided in a receptacle 24, which is formed laterally by the symmetry axis of the trapezoidal plate 16. The receptacle 24 is formed as a slotted hole that extends parallel to the longer base side of the trapezoidal plate 16. The rope guides 17 have rollers 25, 26 at their respective ends, at which the outer circumference a groove is preferably formed. The rope of the rope pull 14 is guided from the outside of the first roller 25, which is not arranged in the receptacle 24, to the inside of the second roller 26. Due to the rope guides 17 being mounted in the respective receptacle 24, the rope guide 17 is mounted so as to be rotatable. The first rollers 25 are mounted on the plate 16 in a rotatable manner. Furthermore, in the receptacle 24, an elastic spring force 18 connected to the rope guide 17 is arranged in each case, which can also be moved in the receptacle and can be fixed in it by means of a screw. This makes it possible to pre-tension the rope guide 17 by means of the spring force 18. By means of the movable and pre-tensioned rope guide 17, compensation in length of the rope pull 14 is thus possible as a function of the rotation movement and the translational movement.

In an alternative embodiment, the disc 19 may also be elliptically formed or not in the center of the additional rail 23, but instead guided laterally offset, so that a rotation of the disc 19 entails an elliptical movement. This also leads to a compensation in length for the rope pull 14. The compensation in length leads to a physiological force curve, so that the force of the training resistances 13 transferred to the coupling member changes as a function of the angle of movement.

Figure 6:
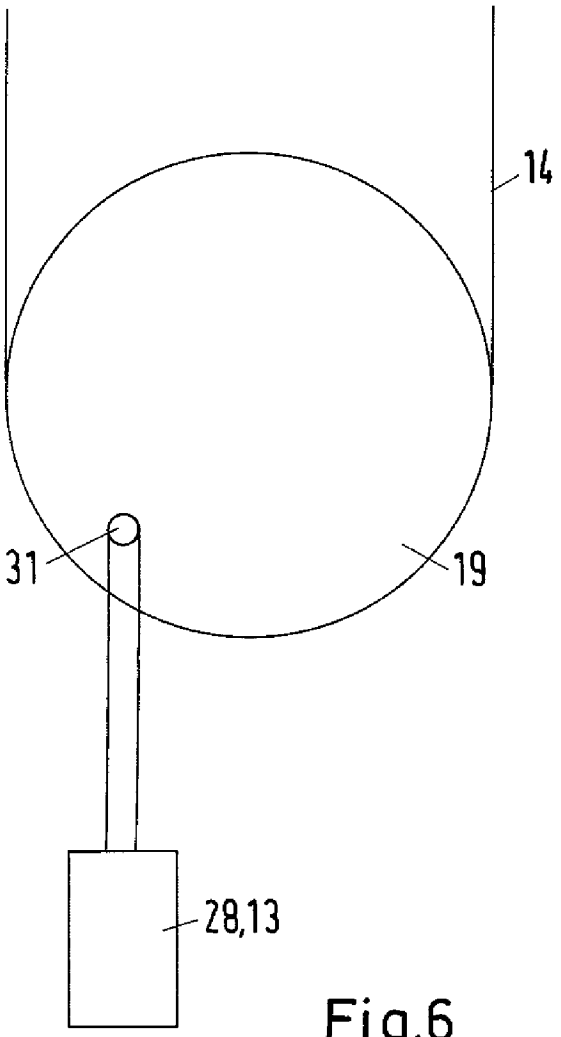
FIG. 6 is an embodiment for the generation of the training resistance.

FIG. 6 shows an alternative embodiment for the generation of the training resistance 13. The training resistance 13 is generated by a resistor 28, in this case a weight, the one end of which is eccentrically attached to the disc 19 by means of a pin 27. To vary the training resistance 13, the pin 27 can also be used in differently positioned pin receptacles of the disc 19. Due to the rotation of the disc 19, the weight 28 is moved against gravity, thus creating resistance. The angular circumference of the exercise movement preferably corresponds to a rotation of disc 19 by less than 180°. The change in height of the resistor 28 corresponds approximately to the sine of the angular change of the disc 19, which in turn approximates a force curve advantageous for physiological exercise. The resistor 28 may be formed as a weight or as a spring or as a rubber band or as hydraulics or the like.

Figure 7:
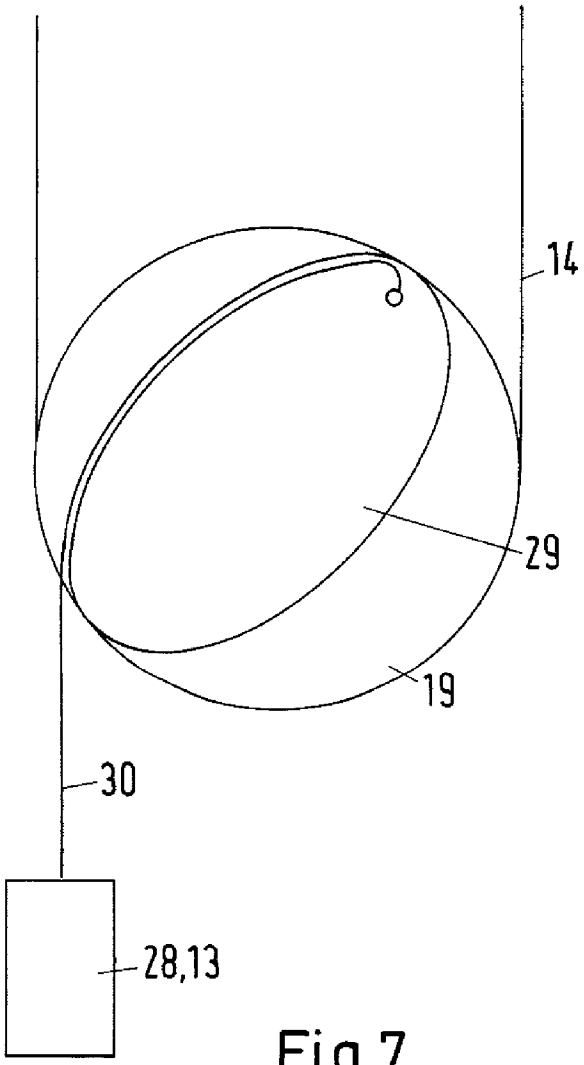
FIG. 7 is an alternative embodiment for the generation of the training resistance.

FIG. 7 shows another alternative embodiment for the generation of a training resistance. On the round disc 19, a non-circular disc 29, in this case an elliptical disc 29, with a groove formed on the outer circumference is attached, over which another rope pull 30 is guided, the one upper end of which is attached to the non-circular disc 29. At the lower end of the further rope pull 30, a resistor 28, in this case a weight, is attached which is moved against gravity during a rotation of the disc 19. An advantage of this embodiment is that the curve of the change in height of the weight 28 relative to a ground is determined via the change in angle and the angular position of the discs 19, 29 and by the outer (non-circular) shape of the non-circular disc 29. Differently shaped non-circular discs 29 thus produce different force-angle curves.

In order to achieve a change in length and movement of the rope pull 14 in the case of rotational movements, but not in the case of translational movements of the coupling member, a tapered bridge construction 20, the two elements of which are jointly connected to each other and over which the rope pull 14 is guided in particular via deflection pulleys, is arranged on one side of the cross slide 4, namely on the top of the frame 2, i.e., on the side of the frame 2 facing away from the ground. The rope pull 14 is guided from the plate 16, over the bridge construction 20 about a deflection disc 27 formed on the translator 8. The deflection disc 27 is arranged on a rotary joint between the translator 8 and the rail 5.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An exercise apparatus for exercising neck muscles, the exercise apparatus comprising:

a frame; and an exercise mechanism which is mounted on the frame and which is adapted to be coupled to a coupling member that is worn on or around the head of a person who is exercising, wherein the exercise mechanism comprises a cross slide which makes available first and second translation axes, and wherein a rail is mounted on the cross slide, the rail being adjustable in height, with respect to the cross slide, along a third translation axis and the rail being rotatable such that via the exercise mechanism, the coupling member is rotatable about first, second and third rotation axes and is movable in translation along the first, second and third translation axes.

2. The exercise apparatus according to claim 1, wherein the cross slide comprises a first slide and a second slide arranged orthogonally to the first slide and movable on the first slide, and wherein a translator is present, which is mounted so as to be movable on the first slide.

3. The exercise apparatus according to claim 2, wherein the rail is guided in a guide, wherein the rail is arranged orthogonally to the cross slide, and wherein the rail is mounted on the translator so as to rotate about the first rotation axis.

4. The exercise apparatus according to claim 1, wherein the first, second and third rotation axes have a common intersection in the region of the cervical spine of the person who is exercising.

5. The exercise apparatus according to claim 4, wherein the common intersection is near the center of the base of the dens axis of the person who is exercising.

6. The exercise apparatus according to claim 1, wherein the rail carries a bracket, which makes available the second and third rotation axes.

7. The exercise apparatus according to claim 6, wherein the bracket is formed as an arch running horizontally at the level of the cervical spine of the person who is exercising or as a U-piece, which is connected to the rail by a rotary joint directly or indirectly for the rotation of the coupling member about the second rotation axis.

8. The exercise apparatus according to claim 7, wherein at least one of the free ends of the arch or the U-piece are rotatably coupled to the coupling member about the third rotation axis at a level of the ear canal of the person who is exercising.

9. The exercise apparatus according to claim 7, wherein the arch or the U-piece is connected to the rail via an angled connecting piece.

10. The exercise apparatus according to claim 1, wherein at least one training resistance is present, wherein a force of the at least one training resistance, that is transferred to the coupling member, is adjustable as a function of the movement and/or the angular position of the coupling member.

11. The exercise apparatus according to claim 10, wherein the at least one training resistance transfers the force to the coupling member via a rope pull.

12. The exercise apparatus according to claim 11, wherein the at least one training resistance is formed by a resistor which generates resistance by a change in position of at least one end of the resistor against the force, wherein the other end of the resistor is eccentrically attached to a disc.

13. The exercise apparatus according to claim 11, wherein the at least one training resistance is formed by a resistor which generates resistance by a change in position of at least one end of the resistor against the force, wherein the other end of the resistor is attached via a further rope pull to a non-circular disc frictionally connected to a disc.

14. The exercise apparatus according to claim 1, wherein the rail is adjustable in height, with respect to the cross slide, along the third translation axis such that a height of the cross slide remains the same while the height of the rail is adjusted.

15. An exercise apparatus for exercising neck muscles, the exercise apparatus comprising:

a frame; and an exercise mechanism which is mounted on the frame and which is adapted to be coupled to a coupling member that is worn on or around the head of a person who is exercising, wherein the exercise mechanism comprises a cross slide which makes available first and second translation axes, wherein a rail is mounted on the cross slide, the rail being adjustable in height along a third translation axis and the rail being rotatable such that via the exercise mechanism, the coupling member is rotatable about first, second and third rotation axes and is movable in translation along the first, second and third translation axes, wherein at least one training resistance is present, wherein a force of the at least one training resistance, that is transferred to the coupling member, is adjustable as a function of the movement and/or the angular position of the coupling member, wherein the at least one training resistance transfers the force to the coupling member via a rope pull, and wherein at least one length compensator is present, over which the rope pull is guided such that the length of the rope pull and thus the force transferred by the at least one training resistance on the coupling member is adjusted as a function of the translational movement and/or the rotational movement.

16. The exercise apparatus according to claim 15, wherein the at least one length compensator is formed as a plate on which two rope guides are arranged which are rotatably mounted, wherein the two rope guides guide the rope pull and are pre-tensioned by a spring force.

17. The exercise apparatus according to claim 15, wherein the at least one length compensator is formed as a disc, on the outer circumference of which a groove is formed in which the rope pull is guided.

* * * * *